US005784468A

United States Patent [19]

Klayman

[11] Patent Number: 5,784,468

[45] Date of Patent: Jul. 21, 1998

[54] SPATIAL ENHANCEMENT SPEAKER SYSTEMS AND METHODS FOR SPATIALLY ENHANCED SOUND REPRODUCTION

[75] Inventor: Arnold I. Klayman, Huntington Beach, Calif.

[73] Assignee: SRS Labs, Inc., Santa Ana, Calif.

[21] Appl. No.: 726,555

[22] Filed: Oct. 7, 1996

[51] Int. Cl.[6] ..... H04R 5/00

[52] U.S. Cl. ..... 381/24

[58] Field of Search ..... 381/24, 17, 18, 381/63, 1

[56] References Cited

U.S. PATENT DOCUMENTS

| | | | |
|---|---|---|---|
| D. 351,388 | 10/1994 | Ballard et al. . | |
| D. 351,839 | 10/1994 | Ballard et al. . | |
| 538,263 | 4/1895 | Kinney . | |
| 709,984 | 9/1902 | How . | |
| 1,786,279 | 12/1930 | Wolff . | |
| 2,580,916 | 1/1952 | Hodge . | |
| 2,643,727 | 6/1953 | Leon . | |
| 2,869,667 | 1/1959 | Leslie . | |
| 2,993,557 | 7/1961 | Miller et al. . | |
| 3,477,540 | 11/1969 | Rizo-Patron . | |
| 3,816,672 | 6/1974 | Gefvert et al. . | |
| 3,848,092 | 11/1974 | Shamma . | |
| 4,107,479 | 8/1978 | Heil . | |
| 4,134,324 | 1/1979 | LeMert . | |
| 4,182,931 | 1/1980 | Kenner . | |
| 4,196,790 | 4/1980 | Reams . | |
| 4,218,583 | 8/1980 | Poulo . | |
| 4,348,549 | 9/1982 | Berlant . | |
| 4,580,654 | 4/1986 | Hale . | |
| 4,594,729 | 6/1986 | Weingartner . | |
| 4,620,317 | 10/1986 | Anderson . | |
| 4,630,298 | 12/1986 | Polk et al. . | |
| 4,638,505 | 1/1987 | Polk et al. . | |
| 4,691,362 | 9/1987 | Eberbach . | |
| 4,759,066 | 7/1988 | Polk et al. . | |
| 4,819,269 | 4/1989 | Klayman | 381/24 |
| 4,924,963 | 5/1990 | Polk et al. . | |
| 5,333,200 | 7/1994 | Cooper et al. | 381/24 |
| 5,412,732 | 5/1995 | Kanishi et al. | 381/24 |
| 5,475,764 | 12/1995 | Polk . | |

FOREIGN PATENT DOCUMENTS

| | | |
|---|---|---|
| 0 252 337 A2 | 1/1988 | European Pat. Off. . |
| 0 330 319 A3 | 8/1989 | European Pat. Off. . |
| 35014 | 2/1966 | Finland . |
| 802404 | 9/1936 | France . |
| 1133759 | 7/1962 | Germany . |
| 2 325 603 | 12/1974 | Germany . |
| 59-0121992 | 8/1984 | Japan . |
| 564 296 | 3/1974 | Switzerland . |
| 830745 | 3/1960 | United Kingdom . |
| 1495536 | 12/1977 | United Kingdom . |

*Primary Examiner*—Curtis Kuntz
*Assistant Examiner*—Vivian Chang
*Attorney, Agent, or Firm*—Knobbe, Martens, Olson & Bear LLP

[57] ABSTRACT

Spatially enhanced sound is produced by vertically radiating a first sound from a left speaker by a first transducer. The first sound includes a sum component and a left difference component. A left difference sound is horizontally radiated from the left speaker by a second transducer. The left difference sound from the first transducer and the left component sound from the second transducer acoustically combine. A second sound is vertically radiated from a right speaker by a third transducer. The second sound includes a sum component and a right difference component. A right difference sound is horizontally radiated from the right speaker by a fourth transducer. The right difference sound from the third transducer and the right component sound from the fourth transducer acoustically combine and the sum component from the right speaker and the sum component from the left speaker acoustically combine.

15 Claims, 9 Drawing Sheets

SPATIAL ENHANCEMENT SPEAKER SYSTEMS AND METHODS FOR SPATIALLY ENHANCED SOUND REPRODUCTION

BACKGROUND OF THE INVENTION

1. Field of the Invention

This invention relates to a speaker system, and, more particularly, to a speaker system which provides for spatially enhanced sound reproduction.

2. Description of the Related Art

Audio is an essential part of modem home entertainment systems, including television, video playback systems, computers and music playback systems.

Thus, producers and consumers of movies demand that movie audio tracks provide an immersive experience for the home listener. Rolling thunder, gun fire, and car crashes are a commonplace part of movie soundtracks. The soundtracks typically incorporate direct field sounds, reverberated field sounds and directional, off-center field sounds. The direct field sounds are intended to be perceived by the listener as being radiated from directly in front of the listener. The reverberant field sounds are intended to be perceived by the listener as being reflected from walls and other obstacles. The directional, off-center field sounds, are intended to be perceived as sound which reaches the listener directly, but from a source which is closer to one ear than an opposite ear.

Similarly, modem home computers typically incorporate multimedia systems capable of playing games, educational programs, and film clips, all of which include an audio component as part of the multimedia experience. The audio component may, for example, include game sound effects, such as 'laser' blasts, or sounds from nature, such as rain. Ideally, the audio components typically incorporate direct field sounds, reverberated field sounds and directional, off-center field sounds for a realistic listener experience.

Additionally, to achieve a realistic reproduction of a live musical performance, especially those of orchestras, a listener must hear sounds as if he is seated in a large concert hall. Thus, the listener must perceive that the sound reproduction is radiated directly at the listener from the orchestra, and that it is reflected from the distant walls of a concert hall.

All of the audio applications described above require the reproduction of a spatial acoustical field that incorporates direct field sound, reverberant field sound, and off-center directional field sound, for the creation of an immersive listening experience. Various approaches have been employed to supply listeners with a spatially enhanced sound experience. One approach, typically used in movie theaters and becoming more prevalent in home systems, utilizes multiple sound channels when recording and playing back a movie soundtrack. When the listener plays back the movie soundtrack, the recorded channels are translated into electrical signals which are fed to multiple speakers placed at strategic positions around the listener. Typically this technique utilizes five or more sound channels each delivered to a single speaker or multiple speakers. The term speaker is used to denote one or more electrical-to-acoustic transducers, which may be mounted in a housing, for producing sound. The speakers may be located to the front, sides and rear of the listener.

The use of multiple channels to provide an improved listening experience has several drawbacks. This technique requires specially recorded material incorporating multi-channel signals which are not found in stereo audio compact discs, records, tapes, or in most movies recorded for home viewing. Furthermore, expensive electronic equipment is often required for multi-channel playback. Multi-channel systems also require multiple speakers beyond the normal pair of stereo speakers found in standard televisions or in a home stereo system. Thus, consumers must go to the added expense of purchasing a larger quantity of speakers to utilize the multichannel approach. Many applications, such as laptop computers or portable electronic musical instruments, do not practically permit speakers to be positioned about a listener. Sound which reproduced from multiple channel, multiple speaker systems, often is perceived by the listener as emanating from discrete point-source locations corresponding to the speaker locations. The localization of sounds to discrete point sources reduces the desired realistic effect when reproducing original sounds.

Another approach for supplying listeners with a spatially enhanced sound experience uses only two stereo tracks. Such an approach is described in U.S. Pat. No. 4,819,269, issued to Arnold I. Klayman. The contents of U.S. Pat. No. 4,819,269, in its entirety, is hereby incorporated by reference. Systems using the '269 invention employ two or more speakers which radiate different portions of the stereo signal in a unique way. The stereo track signals are first processed to produce direct field sum signals and reverberant field difference signals. These direct and reverberant signals are then fed appropriately to speakers and associated transducers positioned about the listener. The direct field signals may be fed to transducers having narrow dispersion patterns, while the reverberant field signals may be fed to transducers having wide dispersion patterns. This approach advantageously requires only the normal stereo tracks to achieve a spatially enhanced listing experience. Additionally, this technique produces sound which does not appear to come from discrete locations, enhancing the perceived audio-immersive effect. However, under the '269 patent a mixture of transducer types—wide and narrow dispersion transducers—is required. Wide dispersion transducers, having dispersion patterns greater than 120°, can be more expensive and larger than transducers having conventional dispersion patterns in the range of 60°. Furthermore, as in the multi-channel system, many systems utilizing this technique incur the expense of having multiple speakers. Accordingly, for some applications, the invention disclosed in the '269 patent is not feasibly implemented.

Yet another approach for supplying listeners with a spatially enhanced sound experience using only two stereo tracks and two speakers is described in my pending application, Ser. No. 08/508,593. The contents of U.S. patent application Ser. No. 08/508,593, in its entirety, is hereby incorporated by reference. The described system enhances and broadens the perceived sound stage by processing and electronically amplifying the magnitude of selected frequencies of the ambient signal information. The processed ambience information, i.e., the difference signal, is then appropriately summed with the left and right channel stereo signals, and the resulting left and right channel signals are fed to respective left and right speakers. This approach advantageously requires only the normal stereo tracks and only two speakers. The enhanced sound stage is achieved through electronic processing of the stereo signals.

Still other approaches to providing the realistic reproduction of sound, include artificial time delays, the introduction of specific and perceptible phase shifts, and added reverberation. However, these approaches introduce undesirable artifacts into the reproduced sound, thus actually decreasing the realism of the reproduced sound.

SUMMARY OF THE INVENTION

This invention provides a substantial improvement in spatially enhanced sound reproduction, using only standard stereo signals as inputs and without requiring additional expensive electronic equipment.

In one preferred embodiment, the system includes a left speaker and a right speaker as oriented with respect to a listener. Each of the left and right speakers have both a vertically mounted transducer which radiates in a horizontal direction and a horizontally mounted transducer which radiates in a vertical direction. The vertically mounted transducer of the left speaker radiates sound based on a left channel stereo signal $L_C$, including a sum component (L+R) and a difference component (L−R). The vertically mounted transducer of the right speaker radiates sound based on a right channel stereo signal $R_C$, including the sum component (L+R) and a difference component (R−L). The horizontally mounted transducer of the left speaker radiates sound based on a left difference component (L−R) of the left stereo channel signal. The horizontally mounted transducer of the right speaker radiates sound based on a right difference component(R−L) of the right stereo channel signal.

In the case of the left speaker, the sound based on the left channel difference signal (L−R), vertically radiating from the horizontally mounted transducer, acoustically combines with the sound based on the difference component (L−R) of the left channel signal, horizontally radiating from the vertically mounted transducer. The resulting combined sound 2(L−R) has twice the power as compared to the sound (L−R) radiating solely from the horizontally positioned transducer.

Similarly, in the case of the right speaker, the sound based on the right channel difference component (R−L) of the right stereo channel, vertically radiating from the horizontally mounted transducer, acoustically combines with the sound based on the difference component (R−L), horizontally radiating from the vertically mounted transducer. The resulting combined sound 2(R−L) has twice the power as compared to the sound (R−L) radiating solely from the horizontally positioned transducer.

Furthermore, the combined sounds 2(L−R), 2(R−L) radiate at 45° from the horizontal, and thus more directly impinge on the listener's ears. Additionally, the combined sounds 2(L−R), 2(R−L) destructively add in front of the listener, creating an acoustic 'hole' or null which results from a dipole effect created by the two speakers. This hole is filled by the acoustic addition of sounds based on the sum components of the left and right channel signals (L+R), (L+R), resulting in a combined sound 2(L+R). Thus, the difference sound fields emanate toward the left and right side of the listener, increasing the perceived sound stage.

The above orientations and intensities of sounds based on the sum and difference signals provide an amazingly realistic listening experience from audio transducers positioned only at left-hand and right-hand locations. By appropriately adding sound fields in space, better audible separation of the sum and difference signals is achieved. Reverberant field sound and directional, off-center field sound appear to the listener to realistically arrive from sources to the listener's left and right, while the direct sound field has greater presence.

DETAILED DESCRIPTION OF THE PREFERRED EMBODIMENTS

The preferred embodiment of the present invention reproduces and orients the direct and reverberant/off-center sound fields, producing spatially enhanced sound from stereo signals.

Stereo signals include a left channel signal and a right channel signal. The left and right channel signals include recorded direct field components, which can be represented by a sum signal (L+R), as well as recorded reverberant/ambient components which, in the preferred embodiment, may be represented as a left difference signal (L−R) and a right difference signal (R−L) respectively. Thus, in the preferred embodiment, the left channel signal $L_C$ and the right channel signal $R_C$ may be defined as follows, where K is a constant representing a level adjust of the constituent signal:

$$L_C=K((L+R)+(L-R)) \quad (1)$$

$$R_C=K((L+R)+(R-L)) \quad (2)$$

Figure 5:
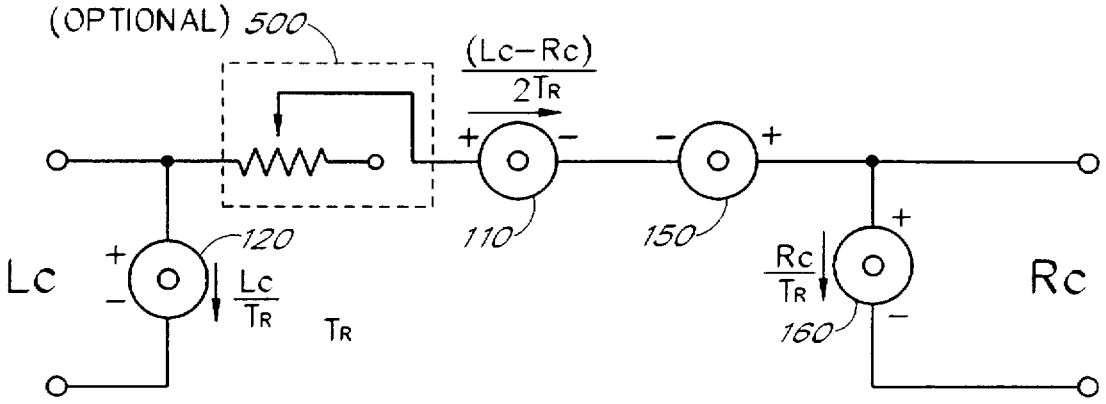
FIG. 5 is a block diagram illustrating a first embodiment of the interconnections of the speaker transducers illustrated in FIG. 1.
Figure 6:
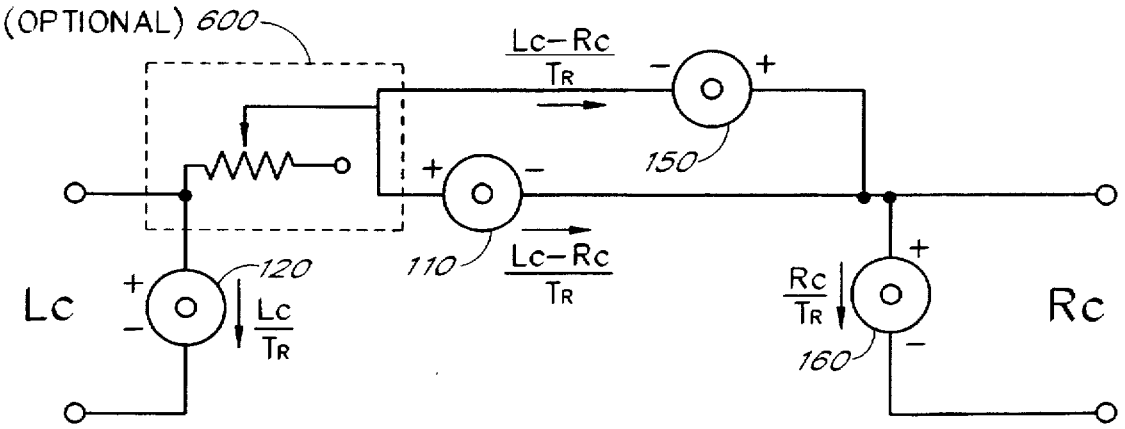
FIG. 6 is a block diagram illustrating a second embodiment of the interconnections of the speaker transducers illustrated in FIG. 1.

Techniques for deriving difference components from stereo signals, and connecting the sum and difference components to speaker transducers, are illustrated in FIGS. 5 and 6. These techniques will be discussed later below.

The direct field sound of a recording is represented by the sum component (L+R), which reaches the listener directly from a location substantially in front of the listener. The reverberant field sound includes sound which reaches the listener after reflected from walls or other objects. In a recording, left and right reverberant field sounds are included in the left and right difference signals respectively (L−R), (R−L). The difference signals may also include directional off-center sound, such as sound coming directly from one side of the listener, which is more audible to one ear as compared to the opposite ear. It is the appropriate reproduction and orientation of the difference signals which cause a listener to feel that he is realistically surrounded or immersed in sound.

Figure 1:
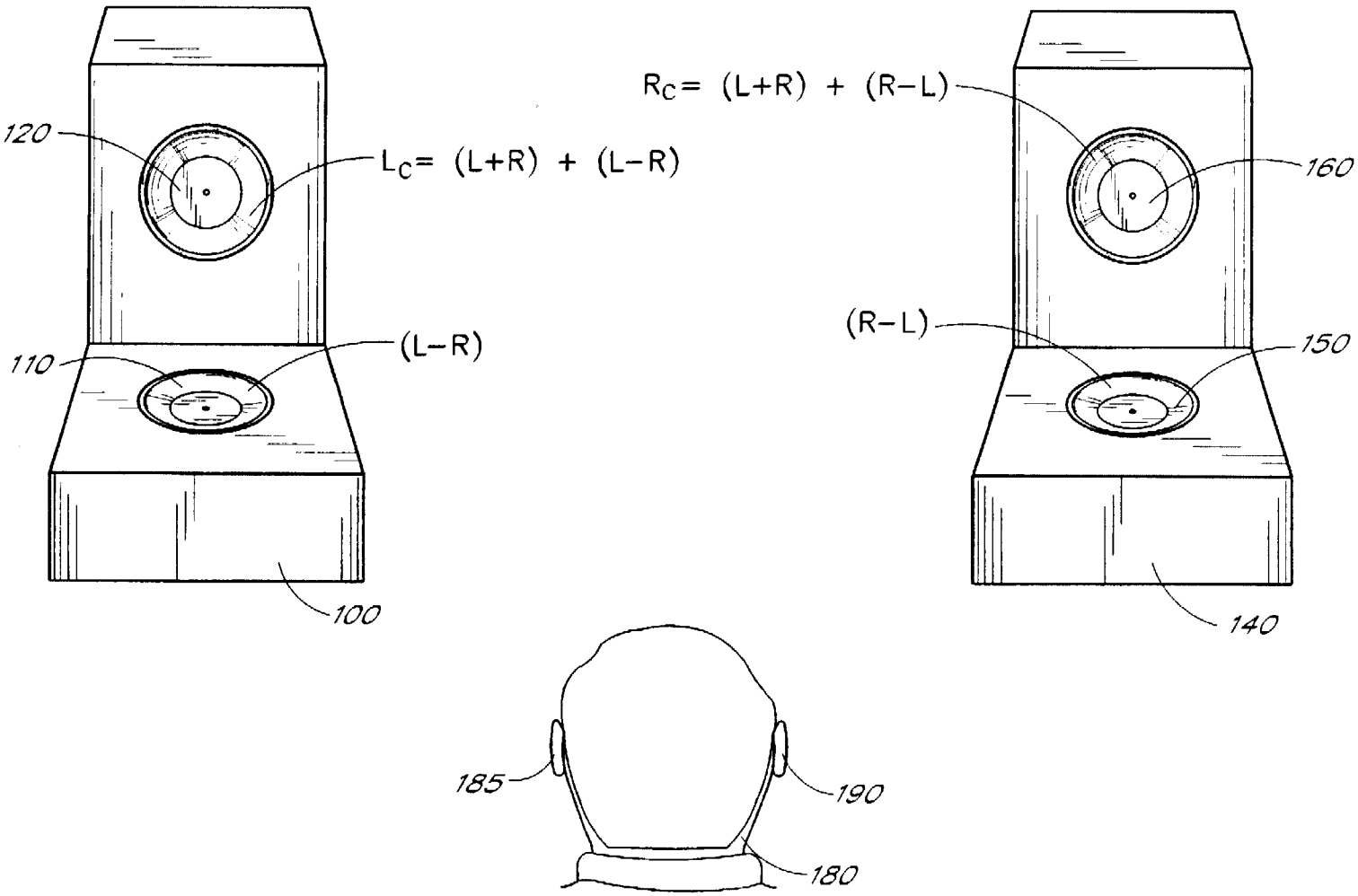
FIG. 1 illustrates a preferred embodiment of a spatial enhancement loudspeaker speaker system.

Referring to FIG. 1, the preferred embodiment of this invention only requires two speaker locations, a left speaker assembly 100 and a right speaker assembly 140 which translate the electrical inputs from a stereo source into sound. The electrical inputs may be received from a variety of stereo sources, including, but not limited to, computers, video tape players, digital video or audio optical disk players, analog video or audio optical disk players, digital storage devices, tape machines, broadcast or cable television sources, and radio receivers. As discussed below, a signal processing device, such as that disclosed in my pending application, Ser. No. 08/508,593, may optionally be interposed between the stereo source and an amplifier driving the speakers 100, 140 for electronic sound enhancement.

In one preferred embodiment, each speaker assembly includes two orthogonally positioned audio transducers. However, as will be discussed below, in other embodiments each speaker assembly may have more than two transducers. Furthermore, the speakers may include tweeters, mid-range elements, woofers, and sub-woofers to reproduce respectively, high frequency signal components, mid-range frequency signal components, low range frequency signal components, and very low range frequency components. Additionally, the transducers may use cone, planar, dome or other technologies and structures.

Referring to FIG. 1, the left speaker assembly 100 includes a vertically positioned transducer 120 and a horizontally positioned transducer 110 located below the vertically positioned transducer 120. Ideally, the transducer 120 is positioned at an approximately 90° angle relative to the transducer 110, though angles approaching 90° may also be used. Similarly, the right speaker assembly 140 includes a vertically positioned transducer 160 and a horizontally positioned transducer 150 positioned at approximately 90° relative to each other. The right speaker assembly 140 is preferably positioned to the right of a listener 180, while the left speaker assembly 100 is preferably positioned to the left of the listener 180. The horizontal transducers 110, 150 are preferably positioned lower than the left and right ears 185, 190 respectively, of the listener 180.

The horizonal and vertical transducers 120, 160, 110, 150 in the left and right speakers 100, 140 preferably have substantially identical dispersion patterns of 60° or greater, though dispersion angles approaching 60° may also be used. The dispersion angle is the angle which spans the outer boundaries of the radiated cone of sound emitted from a transducer.

Figure 2:
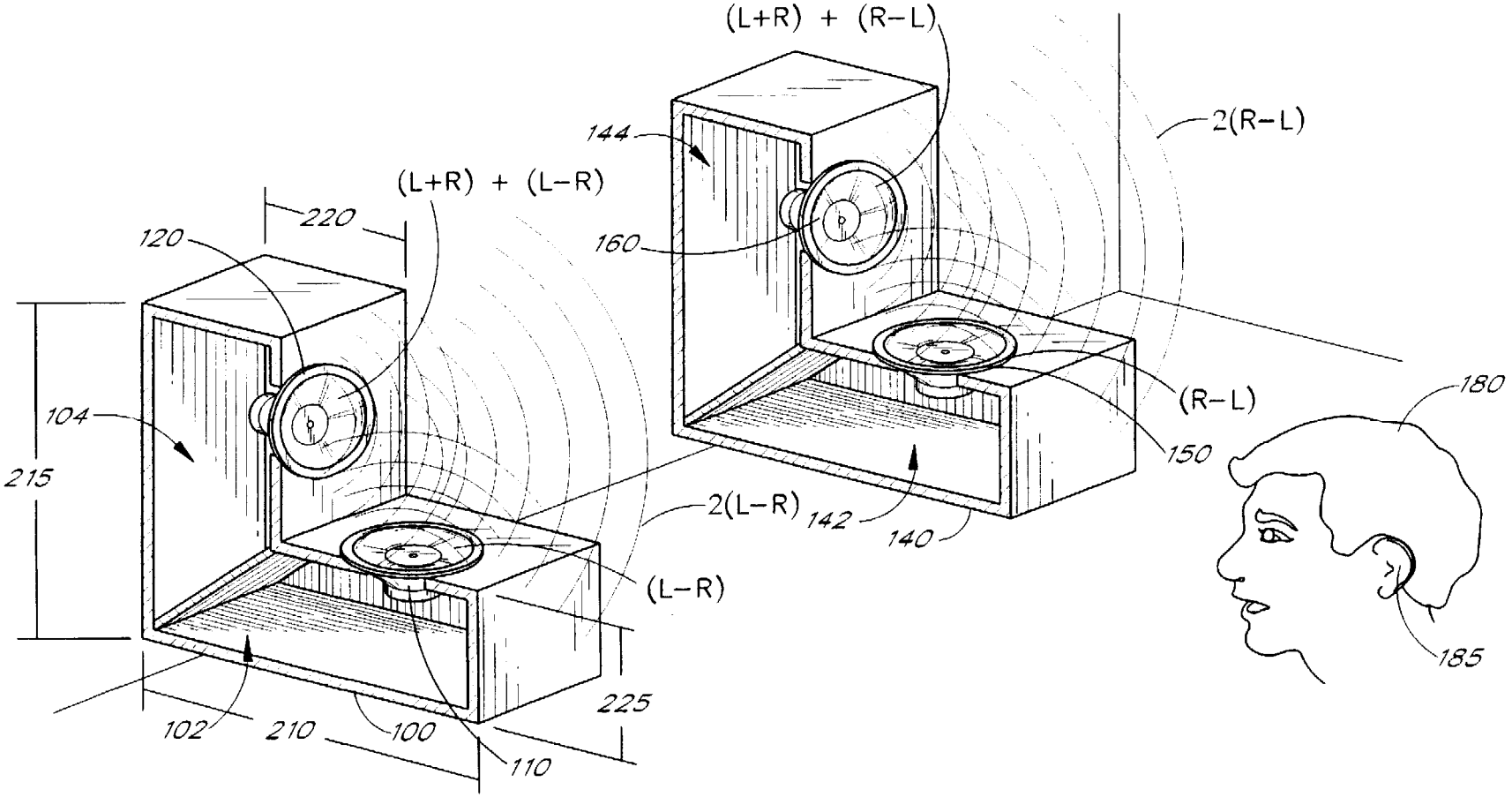
FIG. 2 illustrates the vector addition of difference signals using the loudspeaker system illustrated in FIG. 1.

Referring to FIG. 2, the left speaker assembly 100 has a horizontally positioned chamber 102, in which the horizontally positioned transducer 110 is mounted, and a vertically positioned chamber 104, in which the vertically positioned transducer 120 is mounted. In the preferred embodiment, the horizontal chamber 102 is substantially orthogonal, or perpendicular, to the vertical chamber 104. While in the preferred embodiment, the chambers 102, 104 are part of a single speaker housing, they could alternately be mounted in two separate, appropriately positioned, housings. Similarly, the right speaker assembly 140 has a horizontally positioned chamber 142, in which the horizontally positioned transducer 150 is mounted, and a vertically positioned chamber 144, in which the vertically positioned transducer 160 is mounted. In the preferred embodiment, the horizontal chamber 142 is substantially orthogonal to the vertical chamber 144. For the left speaker 100, the volume enclosed within the horizontal chamber 102 is, in the preferred embodiment, approximately the same as the volume of the vertical chamber 104. Thus, a dimension 215 of the left speaker assembly 100 is substantially the same as a dimension 210, while a dimension 225 is substantially the same as a dimension 22. Having chambers 102, 104 which are the same volume and matched transducers 110, 120 ensures that the radiating sound fields will be directed at 45° and that the output power levels will be matched. Similarly, referring to the right speaker assembly 140, the volume of a chamber 142, housing the horizontally positioned transducer 150, is optimally the same as a volume of a chamber 144, housing the vertically mounted transducer 160. While the vertical 104, 144 and horizontal 102, 142 chambers have the same volume in the preferred embodiment, the present invention can also be used with horizontal and vertical chambers having differing volumes. Furthermore, the present invention can be used without any chambers at all.

In one specific embodiment of the invention, the dimension 210 is 8.5 inches and the dimension 225 is 4.25 inches. The right speaker assembly 140 preferably has the same dimensions as the left speaker assembly 100. The transducers 110, 120, 150, 160 are standard 3 inch cone speakers, which can be purchased from Tonegen or from a variety of other sources.

Speakers 100, 140 can be scaled up or down in size as appropriate for their intended use. Thus, the above dimensioned speakers would be most advantageous for use with a desktop computer system or a small, bookshelf-type, stereo system. This invention is also useful for larger speakers for use with home theater systems, stereo systems, or televisions, while even smaller speakers may be desirable for use with laptop computers.

The transducers 110, 120, 150, 160 are interconnected as illustrated in FIG. 5, as will be discussed later below. The vertically positioned transducer 120 of the left speaker assembly 100 receives the left channel signal $L_C$, which, as defined by Equation 1, includes direct field components, represented in the preferred embodiment by the sum component (L+R), and recorded ambient components, represented the preferred embodiment by the difference component (L−R). The horizontally positioned transducer 110 of the left speaker receives the left difference component (L−R) which represents the left side reverberant and directional, off-center sound fields. The vertically positioned transducer 160 of the right speaker assembly 140 receives the right channel signal $R_C$, which, as illustrated in Equation 2, includes in the preferred embodiment recorded sum (L+R) and right difference (R−L) components. The horizontally positioned transducer 150 of the right speaker, receives the right difference component (R−L) which represents the right side reverberant and directional, off-center sound fields. The left and right channel signals $L_C$, $R_C$, may optionally be received using connectors mounted to a speaker housing speaker connector mounting location. In one embodiment, the connectors may be attached to the rear of the speaker housing.

The operation of the spatial enhancement speaker system will now be described. Referring to FIG. 2, the left difference component (L−R) of the sound field (horizontally radiating from transducer 120 of the left speaker assembly 100) and the left difference sound field (L−R) (vertically radiating from transducer 110 of the left speaker assembly 100) acoustically combine in space by vectorially adding together. The resulting sound field is equal to 2(L−R) and is oriented at approximately 45° from the horizontal. Similarly, the right difference component (R−L) of the sound field (horizontally radiating from transducer 160 of the right speaker assembly 140) and the sound field (R−L) (vertically radiating from transducer 150 of the right speaker assembly 140) vectorially add together in space. The resulting sound field is equal to 2(R−L) and is oriented at approximately 45° from the horizontal.

Figure 3:
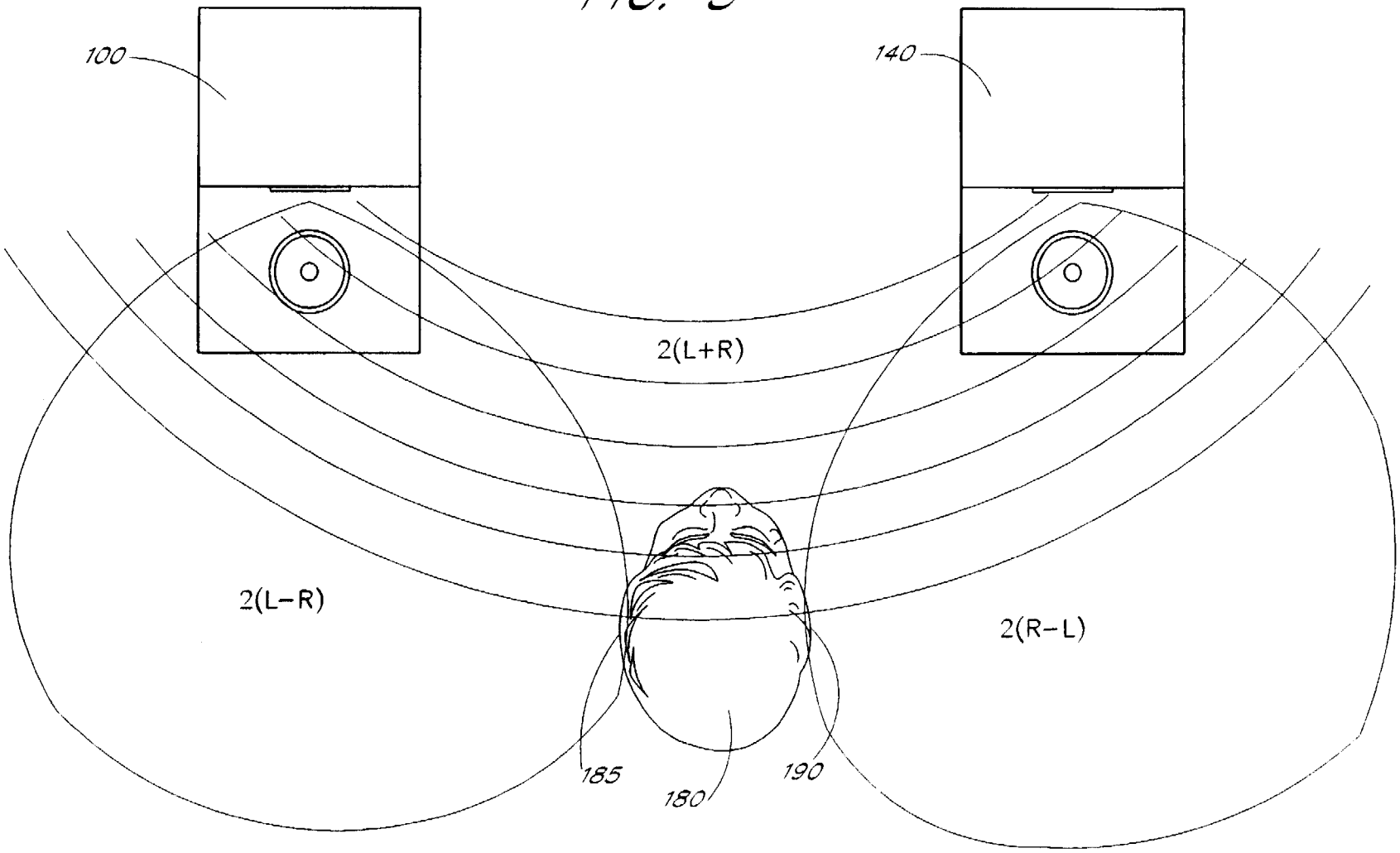
FIG. 3 illustrates the addition of sum signals and the cancellation of difference signals using the loudspeaker system illustrated in FIG. 1.

Furthermore, the left difference signal (L−R) and the right difference signal (R−L) are 180° out of phase relative to each other. Thus, when the sound fields resulting from the left difference signal (L–R) and the right difference signal (R–L) meet in front of the listener, they add together destructively, canceling each other out, as illustrated in FIG. 3. As a result, there is created in front of the listener 180 an audio 'hole' or null in which the left difference audio sounds and the right difference audio sounds are either missing or substantially attenuated. Additionally, the sum sound fields (L+R) from the left and right speakers are coherent, and add together constructively in space, resulting in a sound field equal to 2(L+R). The sound field 2(L+R) fills the 'hole' between the difference sound fields 2(L–R), 2(R–L).

Thus, the spatial enhancement speaker system of this invention very advantageously alters the intensities and orientations of the difference sound fields (L–R), (R–L) and the sum sound field (L+R). The left and right reverberant and directional, off-center, difference sound fields (L–R), (R–L) are doubled in intensity substantially to the respective left and right sides of the listener 180. Furthermore, the resulting doubled difference signals are angled at 45° from the horizontal to more directly impinge on the listener's respective left and right ears 185, 190. By contrast, the difference sound fields (L–R), (R–L) are substantially decreased in an area more directly in front of the listener, while the direct sum sound field (L+R) is advantageously doubled in that same area.

The above orientation and intensities of the sounds based on the sum and difference signals provide an enhanced and truly amazing listening experience. Better audible separation of the sum and difference based sounds is achieved. Reverberant field sound and directional, off-center field sound appear to the listener to realistically arrive from sources to the listener's left and right, while the direct sound field has greater presence. Orchestral performances have a wider sound stage, while recorded reverberant sound, resulting from wall reflections or studio processing, is accurately reproduced.

Thus, a wide sound stage is provided using only two speaker assemblies. This invention produces greatly improved audio sound with inexpensive standard transducers for sound reproduction and only two channels for the audio source.

FIG. 5 illustrates a first embodiment for interconnecting the individual audio speaker transducers 110, 120, 150, 160 (shown in FIGS. 1 and 2) to appropriately derive and route the difference signals (L–R), (R–L). The left channel output $L_C$ of a stereo source is connected across the left vertical transducer 120. A positive terminal of the left vertical transducer 120 is connected to a positive terminal of the left horizontal transducer 110. A negative terminal of the left horizontal transducer 110 is connected to a negative terminal of the right horizontal transducer 150. A positive terminal of the right horizontal transducer 150 is connected to a positive terminal of the right vertical transducer 160. The right channel output $R_C$ of the stereo source is connected across the right vertical transducer 160.

Assuming that all of the transducers 110, 120, 150, 160 have a transducer impedance equal to $T_R$, the left vertical transducer 120 receives a current $L_C/T_R$, while the right vertical transducer 160 receives a current $R_C/T_R$. The left and right horizontal transducers 110, 150 receive a difference current $(L_C-R_C)/2T_R$. However, the left horizontal transducer 110 receives the difference current $(L_C-R_C)/2T_R$ into its positive terminal, while the right horizontal transducer 150 receives the difference current $(L_C-R_C)/2T_R$ into its negative terminal. Thus, the right horizontal transducer 150 will be driven 180° out of phase with respect to the left horizontal transducer 110. Therefore, the right horizontal transducer 150 is driven as if it received a difference current $(R_C-T_C)/2T_R$ on its positive terminal.

Connecting an optional potentiometer 500 in series with the left and right horizontal transducers 110, 150 provides the listener the ability to control the emphasis applied to the sound based on the difference signal (L–R). The difference current equals $(L_C-R_C)/(2T_R+P_R)$, where $P_R$ is the resistance of the potentiometer 500. Thus, the higher the listener sets the resistance on the potentiometer 500, the less the difference current, and hence the less the difference sound emphasis.

The embodiment illustrated in FIG. 6 provides additional emphasis to the difference signal. As described below, this embodiment provides twice the difference current as compared to the embodiment illustrated in FIG. 5, by connecting the left and right horizontal transducers 110, 150 in parallel rather than in series.

The left channel output $L_C$ of a stereo source is connected across the left vertical transducer 120. The positive terminal of the left vertical transducer 120 is connected to the positive terminal of the left horizontal transducer 110. A negative terminal of the left horizontal transducer 110 is connected to a positive terminal of the right vertical transducer 160. The negative terminal of the right horizontal transducer 150 is connected to the positive terminal of the left vertical transducer 120. The positive terminal of the right horizontal transducer 150 is connected to the positive terminal of the right vertical transducer 160. The right channel output $R_C$ of the stereo source is connected across the right vertical transducer 160.

Assuming that all of the transducers 110, 120, 150, 160 have a impedance equal to $T_R$, the left vertical transducer 120 receives a current $L_C/T_R$, while the right channel vertical transducer 160 receives a current $R_C/T_R$. The left and right horizontal transducers 110, 150 are connected in parallel, and thus each receives a difference current $(L_C-R_C)/T_R$. Therefore, the left horizontal speaker receives an unattenuated difference current $(L_C-R_C)/T_R$ at its positive terminal, and the right horizontal speaker effectively receives an unattenuated difference current $(R_C-L_C)/T_R$ at its positive terminal. Thus, the difference currents supplied to the horizontal transducers 110, 150 in the embodiment illustrated in FIG. 6 are twice that of the difference current $(L_C-_C)/2T_R$ supplied to the horizontal transducers 110, 150 in the embodiment illustrated in FIG. 5.

Connecting an optional potentiometer 600 in series with the parallel arrangement of left and right horizontal transducers 110, 150 provides the listener the ability to control the emphasis applied to the sound based on the difference signal (L–R). The difference current equals $(L_C-R_C)/(T_R+P_R)$, where $P_R$ is the resistance of the potentiometer 600. Thus, the higher the listener sets the resistance on the potentiometer 600, the less the difference current, and hence the less the difference sound emphasis.

As previously discussed, while the spatially enhancing speaker system described above can be produced using only two transducers per speaker, even better sound performance can be achieved using multiple transducers, each optimized to reproduce selected frequency ranges. The trade-off for improved performance is the added cost for the additional transducers.

Figure 4A:
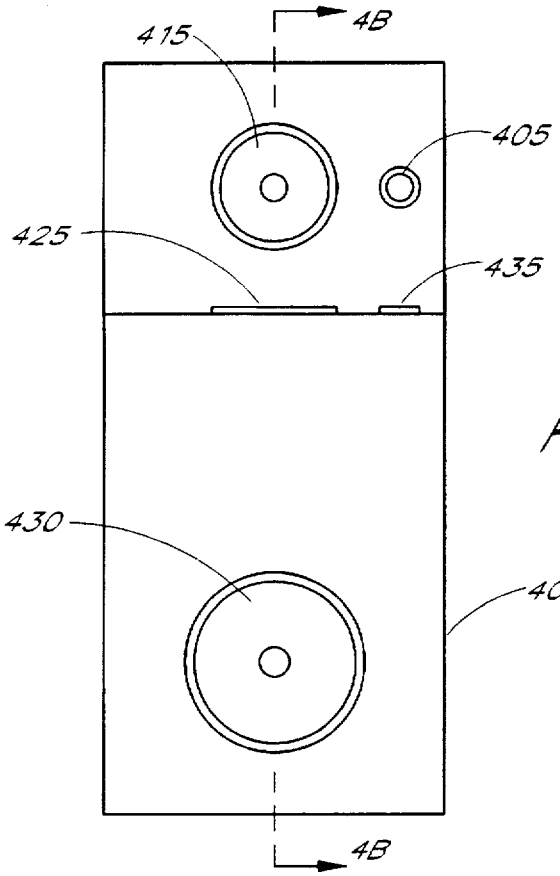
FIGS. 4A, 4B illustrate a preferred embodiment of a spatial enhancement three-way speaker.
Figure 4B:
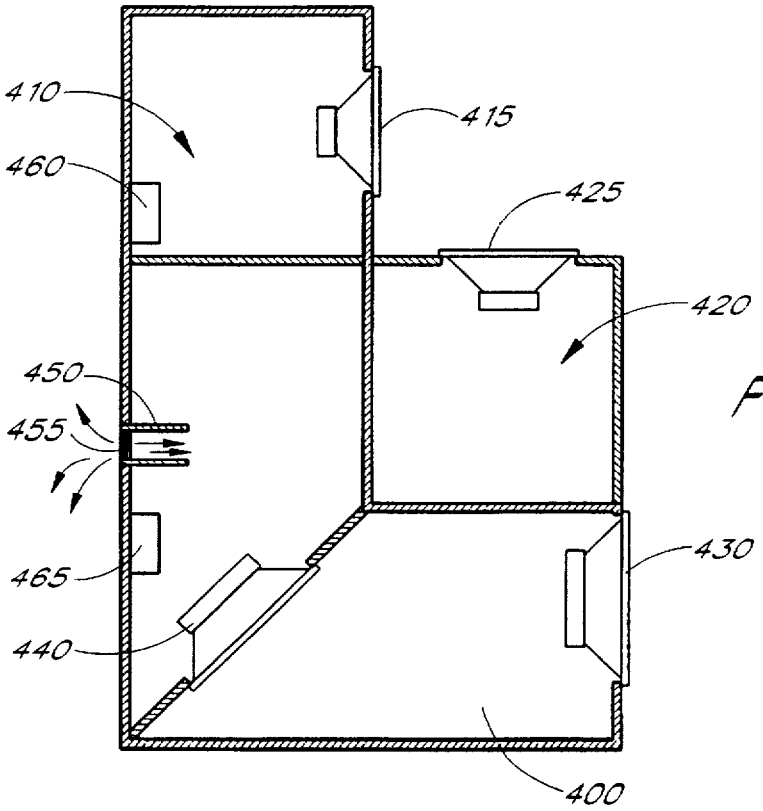

Thus, in a three way speaker system (including high, medium and low frequency transducers), illustrated in FIGS. 4A, 4B, a speaker assembly 400 (to be used as one of a pair of left and right speaker assemblies) has vertically and horizontally mounted mid-range frequency (100 Hz–2,500

Hz) transducers 415, 425, vertically and horizontally mounted high frequency (2,500 Hz–20 KHz) transducers 405, 435, and two low frequency (18 Hz–100 Hz) transducers 430, 440. Typically, mid-range and low frequency transducers are cone elements, while high frequency transducers may be dome or horn tweeter elements. In one preferred embodiment, the high frequency transducers 405, 435 are 1 inch dome tweeters, the mid-range transducers 415, 425 are 6 inch cones, and the low range transducers 430, 440 are 8 inch cones. A cross-over network, as is well known by one skilled in the art, is used to filter out frequencies outside of a given transducer's operating range. In a specific embodiment, a low frequency cross-over network 465 filters out or attenuates frequencies above 100 Hz from the signal going to the low range transducers 430, 440 and passes frequencies above 100 Hz through to the mid-range transducers 415, 425. A mid-range frequency cross-over network 460 filters out or attenuates frequencies above 2,500 Hz from the signal going to the mid-range transducers 415, 425 and passes frequencies above 2,500 Hz through to the high frequency transducers 405, 435.

In the preferred embodiment, the volume of a chamber 420, housing the horizontally positioned transducer 425, is optimally the same as a volume of a chamber 410, housing the vertically mounted transducer 415.

The speaker assembly 400 further includes a port 455 with a vent tube 450. The port 455 and the vent tube 450 are used to appropriately tune the enclosure of the speaker assembly 400 to a resonant frequency, as is well known to one skilled in the art. Incorporation of the port 455 and vent tube 450 into the speaker further enhances speaker efficiency and performance, though the port 455 and vent tube 450 are not necessary for the operation of the present invention.

As in the embodiment illustrated in FIGS. 1 and 2, left and right speakers constructed as illustrated in FIGS. 4A and 4B are used to provide spatially enhanced stereophonic sound. The operation of the three-way speaker system is conceptually the same as the system illustrated in FIG. 2. In the present preferred embodiment, the vertically mounted high frequency and mid-range transducers in the left and right speakers receive their respective stereo signals having sum and difference components. The horizontally mounted high frequency and mid-range transducers in the left and right speakers receive their respective difference signal. The difference component sound from the vertical and horizontal transducers vectorially add together in space. The resulting sound field is equal to twice the original difference signal and is at approximately 45° from the horizontal.

Furthermore, the left difference signal (L–R) and the right difference signal (R–L) are 180° out of phase relative to each other. Thus, when the sound fields resulting from the left difference signal (L–R) and the right difference signal (R–L) meet in front of the listener, they add together destructively, canceling each other out. Additionally, the sum sound fields (L+R) from the left and right speakers are coherent, and add together constructively, resulting in a sound field equal to 2(L+R).

Figure 8:
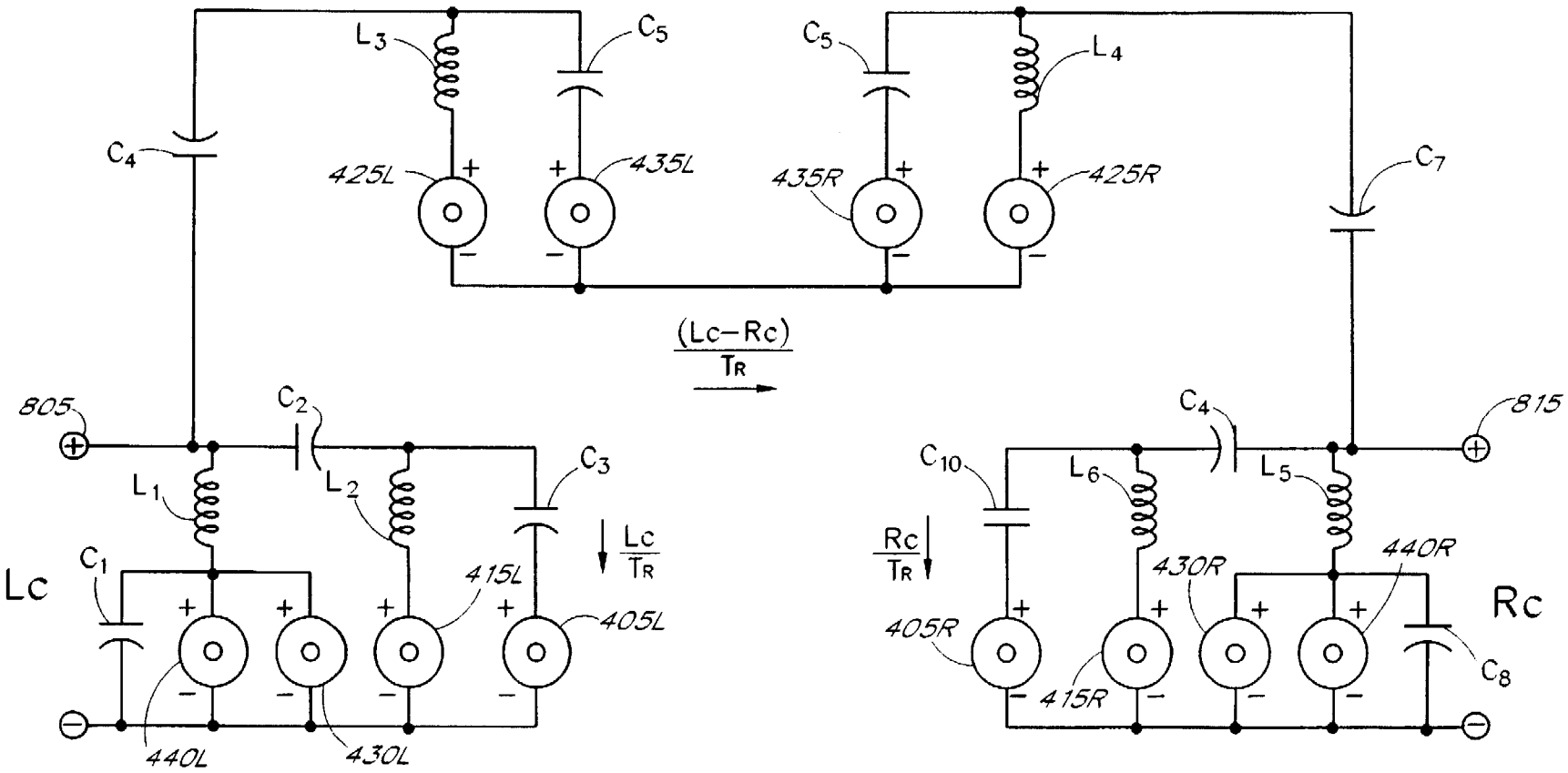
FIG. 8 is a block diagram illustrating a preferred embodiment of the interconnections of the speaker transducers illustrated in FIGS. 4A, 4B.

Low frequency sounds below 200 Hz do not contain significant direction information, limiting the benefits of using orthogonally positioned low frequency transducers. The use of orthogonally positioned transducers to reproduce low frequency sound would only marginally enhance the spatial qualities of the reproduced sound, while adding significantly to the size and cost of the speaker. Thus, one preferred embodiment uses two non-orthogonally positioned low frequency transducers 430, 440, as illustrated in FIG. 4B. The low frequency transducers are driven in phase by a respective stereo signal having sum plus difference components, as illustrated in FIG. 8. The low frequency transducers 430, 440 act in a push-pull arrangement so that the air between the transducers 430, 440 moves with the transducers, but the air is neither compressed nor expanded. This results in a low frequency reproduction system with a large moving mass, including both the mass of the moving portions of the transducers 430, 440 and the mass of the air between them. Furthermore, this approach results in a system which reproduces low frequency sounds using a small structure which operates efficiently. However, the technique used for reproducing low frequency sounds is not critical. Many other approaches can be used for low frequency sound reproduction, including the use of a single woofer cone.

The dispersion pattern of the speaker assembly 400 is advantageously increased using multiple transducers as described above, improving the spatial enhancement capability of the speaker pair. Higher frequencies require wide dispersion to optimally reproduce the reverberant sound field. However, as is well known in the art, as wavelengths of sound become shorter in relation to a diameter of a radiating area of a transducer, the angular dispersion becomes narrower. Thus, an 8 inch low frequency cone woofer provides adequate dispersion for frequencies up to 800 Hz. A 6 inch mid-range cone provides adequate dispersion for frequencies up to 2.5 KHz. A 1 inch dome tweeter provides adequate dispersion for frequencies up to at least 10 KHz. Therefore, by using transducers with different diameters to reproduce different frequencies, adequate dispersion is provided at all frequency ranges, and reproduction of the difference signals (L–R), (R–L) is enhanced.

FIG. 8 illustrates a specific embodiment for interconnecting individual audio speaker transducers 405L, 415L, 425L, 430L, 435L, 440L of a left speaker and individual transducers 405R, 415R, 425R, 430R, 435R, 440R of a right speaker built in accordance with FIGS. 4A and 4B and as described above. The cross-over elements C1, C2, C3, C4, C5, C6, C7, C8, C9, C10, L1, L2, L3, L4, L5, L6 are used to appropriately filter the signals going to each transducer, as described below. The left channel output $L_C$ of a stereo source is connected across the left vertical high frequency transducer 405L, the left vertical mid-range transducer 415L, and the left low range transducers 430L, 440L, and the cross-over elements C1, C2, C3, L1, L2 associated with the transducers 405L, 415L, 430L, 440L. The cross-over elements, including inductor L1 and capacitor C1, filter out frequencies above 100 Hz from the signal going to the left low range transducers 430L, 440L. The capacitor C2 filters out frequencies lower than 100 Hz from the signal going to the left vertical mid-range transducer 415L and the left vertical high frequency transducer 405L. The inductor L2 filters out frequencies above 2,500 Hz from the signal going to the left vertical mid-range transducer 415L. The capacitor C3 filters out frequencies below 2,500 Hz from the signal going to the left vertical high frequency transducer 405L.

A positive terminal of the left horizontal high frequency transducer 435L, and a positive terminal of the left horizontal mid-range transducer 425L are connected through cross-over elements C4, C5, L3 to a positive terminal of the left channel input terminal 805. The capacitor C4 filters out frequencies lower than 100 Hz from the signal going to the left horizontal mid-range transducer 425L and the left horizontal high frequency transducer 435L. The inductor L3 filters out frequencies above 2,500 Hz from the signal going to the left horizontal mid-range transducer 425L. The capacitor C5 filters out frequencies below 2,500 Hz from the signal going to the left horizontal high frequency transducer 435L.

A negative terminal of the left horizontal high frequency transducer 435L is connected to a negative terminal of the left horizontal mid-range transducer 425L, the negative terminal of the right horizontal high frequency transducer 435R, and the right horizontal mid-range transducer 425R. A positive terminal of the right horizontal high frequency transducer 435R, and a positive terminal of the right horizontal mid-range transducer 425R are connected through the cross-over elements C6, C7, L4 to a positive terminal of the right channel input terminal 815. The cross-over elements provide the same filtering functions for the right speaker transducers 435R, 425R as the cross-over elements C5, C4, L3, described above, provide for the left speaker transducers 435L, 425L.

The right channel output $R_C$ of the stereo source is connected across the right vertical high frequency transducer 405R, the vertical mid-range transducer 415R, and the low range transducers 430R, 440R and the cross-over elements C8, C9, C10, L5, L6 associated with the transducers 405R, 415R, 430R, 440R. The cross-over elements C8, C9, C10, L5, L6 provide the same filtering function for the right speaker transducers 440R, 430R, 415R, 405R that the cross-over elements Cl, C2, C3, L1, L2 provide for the left speaker transducers 440L, 430L, 415L, 405L.

Assuming that all of the transducers 405L, 415L, 425L, 430L, 435L, 440L, of a left speaker and individual transducers 405R, 415R, 425R, 430R, 435R, 440R have a transducer impedance equal to $T_R$ (and treating the cross-over elements C2, C3, C4, C5, C6, C7, C9, C10, L1, L2, L3, L4, L5, L6 as purely conductive wires, and the cross-over elements C1, C8 as open circuits) the left vertical transducers 405L, 415L, 430L, 440L receive a current $L_C/T_R$, while the right vertical transducers 405R, 415R, 430R, 440R receive a current $R_C/T_R$. The left and right horizontal transducers 435L, 425L, 435R, 425R receive a difference current $(L_C-R_C)/T_R$. However, the left horizontal transducers 435L, 425L receive the difference current $(L_C-R_C)T_R$ into their positive terminals, while the right horizontal transducers 435R, 425R receive the difference current $(L_C-R_C)/T_R$ into their negative terminal. Thus, the right horizontal transducers 435R, 425R will be driven 180° out of phase with respect to the left horizontal transducers 435L, 425L. Therefore, the right horizontal transducers 435R, 425R are driven as if they received a difference current $(R_C-L_C)/T_R$ on their positive terminals.

Figure 7:
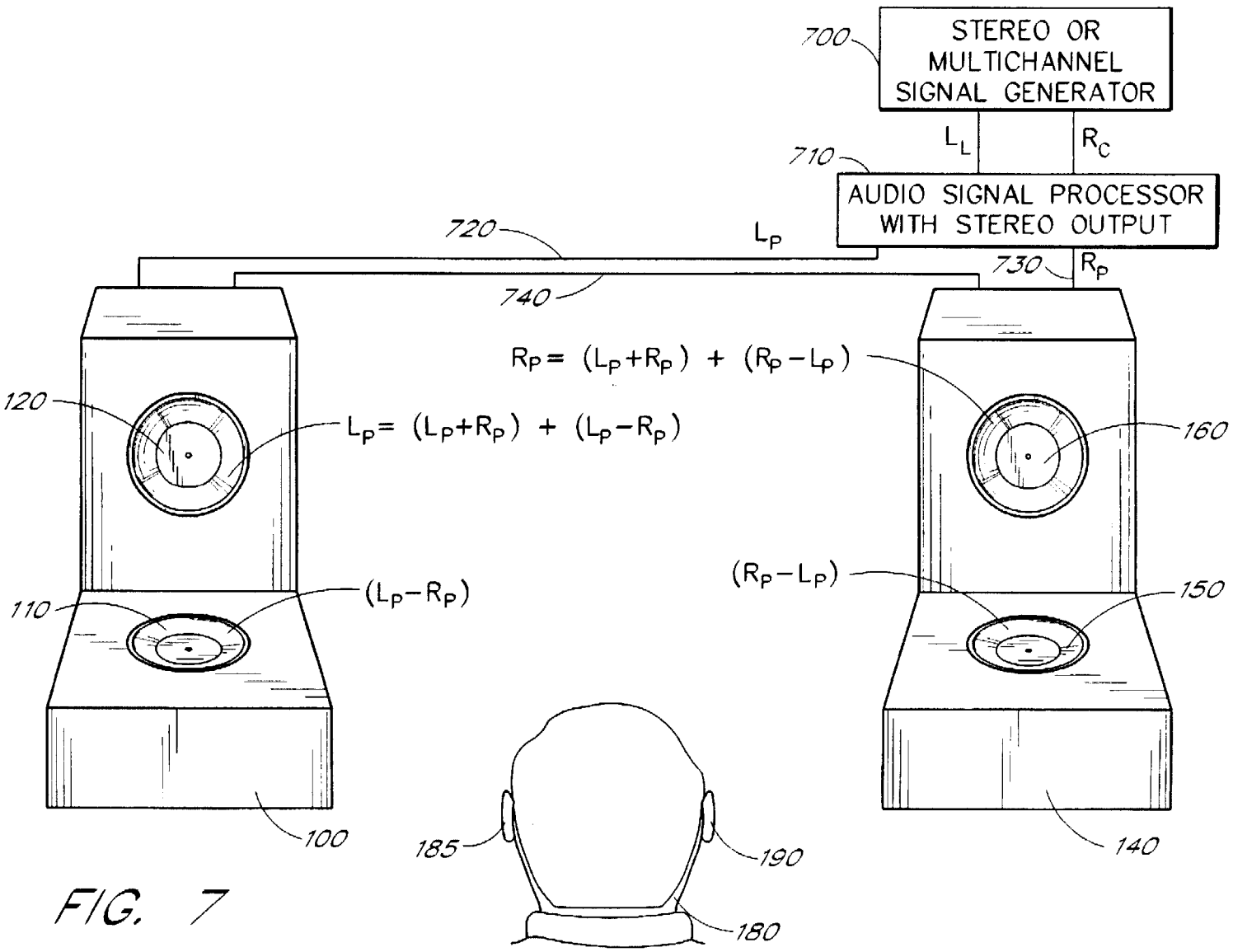
FIG. 7 illustrates a preferred embodiment of a spatial enhancement loudspeaker system used with an electronic sound enhancement system.

Referring now to FIG. 7, further spatial enhancement of the reproduced sound can be achieved using electronic processing of the left and right channel systems. A signal processing device, such as that disclosed in my pending application, Ser. No. 08/508,593, may optionally be interposed between the stereo source and the speakers 100, 140 for electronic sound enhancement.

FIG. 7 illustrates one preferred embodiment of a stereo system, including a stereo or multi-channel signal generator 700 having stereo outputs $L_C$ and $R_C$. The left and right stereo outputs $L_C$ and $R_C$ are connected to an audio signal processor 710 which processes and amplifies the stereo signals to produce processed signals $L_P$ and $R_P$ which can be used to drive a pair of speakers. The left and right stereo outputs $L_P$, $R_P$ are connected to the left and right speakers 100, 140 as illustrated in FIG. 7. Thus, the left output $L_P$ is connected via a two-wire conductor 720 to the left speaker 100. The right output $R_P$ is connected via a two-wire conductor 730 to the right speaker 140. The negative terminal of the horizontal transducer 110 is connected to the negative terminal of the horizontal right transducer 150 by a conductor 740. Thus, the vertically positioned transducer 120 of the left speaker assembly 100 receives the processed left channel signal $L_P$, which, in accordance with Equation 1, includes the sum of the processed stereo signals $(L_P+R_P)$ and the difference of the processed stereo signals $(L_P-R_P)$. The horizontally positioned transducer 110 of the left speaker receives the difference component of the processed stereo signals $(L_P-R_P)$ which represents the left side reverberant and directional, off-center sound fields.

The vertically positioned transducer 160 of the right speaker assembly 140 receives the processed right channel signal $R_P$, which includes processed sum $(L_P+R_P)$ and processed right difference $(R_P-L_P)$ components. The horizontally positioned transducer 150 of the right speaker receives the processed right difference component $(R_P-L_P)$ which represents the right side reverberant and directional, off-center sound fields.

By radiating the processed sum and difference signals $(L_P+R_P)$, $(L_P-R_P)$ in accordance with FIG. 7, the corresponding sounds will be oriented and intensified in a manner similar to that illustrated in FIG. 2, except that the radiated sounds are based on the sum and difference components of the processed stereo signals $L_P$, $R_P$. The processed difference signals $L_P$, $R_P$ can be achieved by applying frequency correction to the un-processed ambient difference components $(L_C-R_C)$, $(R_C-L_C)$ to broaden the apparent sound image and by boosting the un-processed sum component of the left and right stereo channel $(L_C+R_C)$. Thus, combining electronic processing of portions of the original stereo signals $L_C$, $R_C$, with acoustic enhancement from speakers built in accordance with the present invention, results in an even greater enhancement of the spatial sound stage than could be achieved using only the electronic processing or a preferred embodiment of the present invention.

Figure 9:
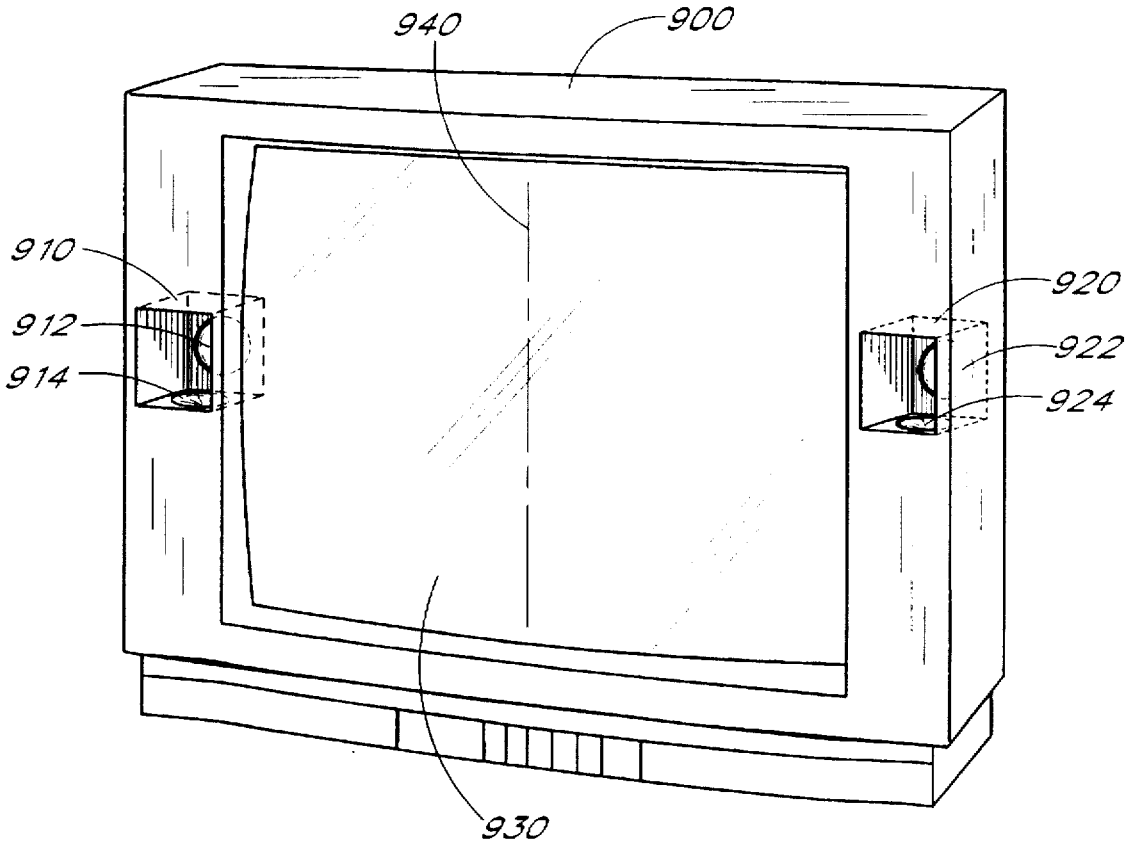
FIG. 9 illustrates a preferred embodiment of a television system incorporating a spatial enhancement loudspeaker speaker system.

FIG. 9 illustrates a preferred embodiment of a television system 900 incorporating a spatial enhancement loudspeaker speaker system. The television system 900 includes a display 930 having a middle or center location represented by the line 940. Generally, it is preferred that the television system 900 includes a left speaker 910 positioned to the left of the line 940 drawn through the center of the display 930, and a right speaker 920 positioned to the right of the center line 940. The television system 900 in the preferred embodiment illustrated in FIG. 9 includes the left speaker 910 positioned on the left side of the display 930 and the right speaker 920 positioned on the right side of the display. In an another preferred embodiment, the left speaker 910 and the right speaker 920 may be positioned towards the rear of the display 930. In the preferred embodiment the speakers are mounted into respective speaker housings integral with the television cabinet. The left speaker 910 includes a substantially vertically positioned transducer 910 and a transducer 914 positioned substantially orthogonal to the transducer 910. The transducer 910 receives a left channel signal $L_C$, which, as defined by Equation 1, includes direct field components, represented in the preferred embodiment by the sum component (L+R), and recorded ambient components, represented the preferred embodiment by the difference component (L−R). The transducer 914 of the left speaker 910 receives the left difference component (L−R) which represents the left side reverberant and directional, off-center sound fields.

Similarly, the right speaker 920 includes a substantially vertically positioned transducer 922 and a transducer 924 positioned substantially orthogonal to the transducer 922. The transducer 922 receives a right channel signal $R_C$, which includes direct field components, represented in the preferred embodiment by the sum component (L+R), and recorded ambient components, represented the preferred embodiment by the difference component (R–L). The transducer 924 of the left speaker 920 receives the right difference component (R–L) which represents the right side reverberant and directional, off-center sound fields.

In another preferred embodiment, the television system 900 may incorporate a video playback device, such as digital video disc player or a video tape player as a source of stereo signals connected to the left and right speakers 910, 920.

Figure 10:
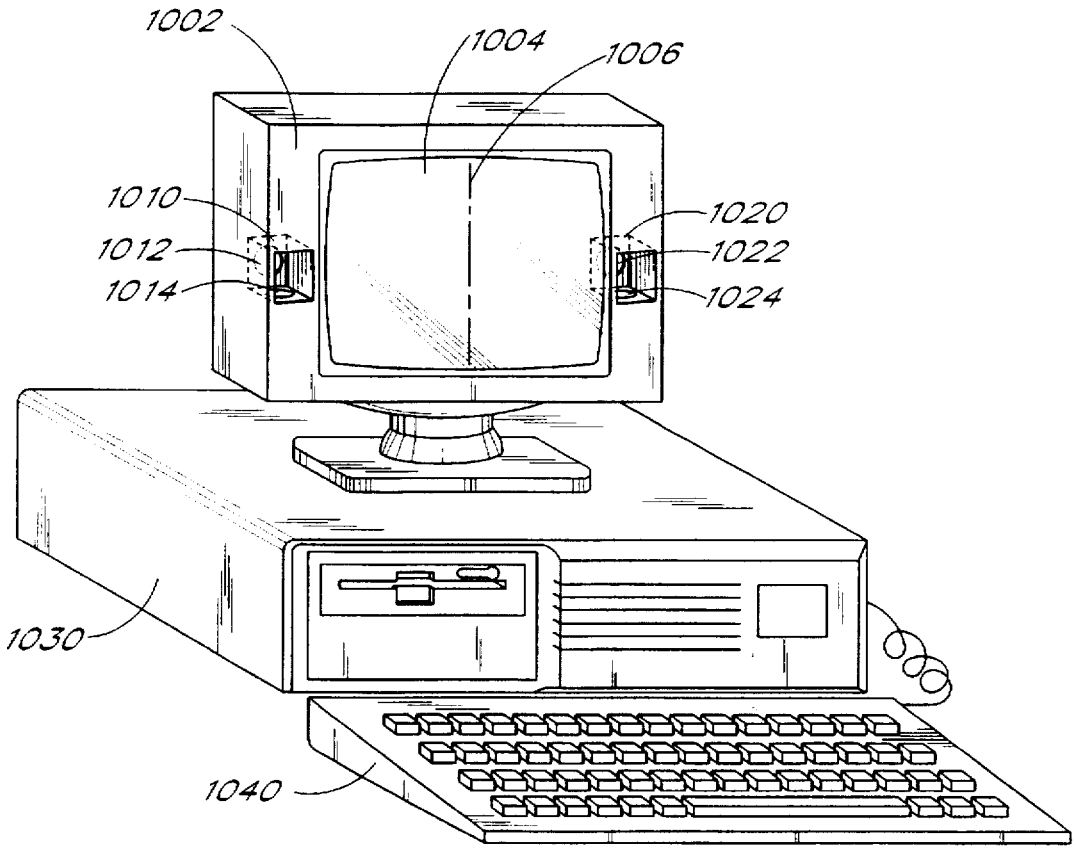
FIG. 10 illustrates a preferred embodiment of a computer system incorporating a spatial enhancement loudspeaker speaker system.

FIG. 10 illustrates a preferred embodiment of a computer system 1000 incorporating a spatial enhancement loudspeaker speaker system. The computer system 1000 includes a monitor 1002 having a display 1004, a computing component 1030, and a keyboard 1040. In the preferred embodiment, the computing component 1030 is connected to the display 1004 and the keyboard 1040 is connected to the computing component 1030. The computing component 1030 may include a central processing unit, memory, a magnetic storage device, an optical storage device, and computer network interfaces. The monitor 1002 includes a left speaker 1010 positioned, in the preferred embodiment, on the left side of the display 1004 and a right speaker 1020 positioned, in the preferred embodiment, on the right side of the display 1004. The left speaker 1010 includes a substantially vertically positioned transducer 1010 and a transducer 1014 positioned substantially orthogonal to the transducer 1010. The transducer 1010 receives a left channel signal $L_C$, which, as defined by Equation 1, includes direct field components, represented in the preferred embodiment by the sum component (L+R), and recorded ambient components, represented the preferred embodiment by the difference component (L–R). The transducer 1014 of the left speaker 1010 receives the left difference component (L–R) which represents the left side reverberant and directional, off-center sound fields.

Similarly, the right speaker 1020 includes a substantially vertically positioned transducer 1022 and a transducer 1024 positioned substantially orthogonal to the transducer 1022. The transducer 1022 receives a right channel signal $R_C$, which includes direct field components, represented in the preferred embodiment by the sum component (L+R), and recorded ambient components, represented the preferred embodiment by the difference component (R–L). The transducer 1024 of the left speaker 1020 receives the right difference component (R–L) which represents the right side reverberant and directional, off-center sound fields.

In another preferred embodiment, the speaker 1010 may be positioned underneath the display 1004, to the left of an imaginary vertical line 1006 drawn through the center or middle of the display. Similarly, the speaker 1020 may be positioned underneath the display 1004, to the right of the imaginary vertical line 1006 drawn through the center or middle of the display.

Incorporating a spatial enhancement loudspeaker speaker system into a computer system 1000 permits computer users to enjoy an enveloping sound experience when operating multimedia programs.

The embodiments of a spatial enhancement speaker system described herein are exemplary embodiments in accordance with the present invention, and are not intended to limit the scope of the invention. Thus, the breadth and scope of the invention should be defined only in accordance with the following claims and their equivalents.

What is claimed is:

1. A method for spatially enhanced sound reproduction in which audio speakers are located substantially at two locations whereas the sound experienced by a listener is perceived to emanate over a wide field and not from discrete locations, said method comprising the steps of:

radiating first sound waves having a sum component and a difference component so that said first sound waves are emanated from a generally vertical axis at a left-hand location;

radiating left difference sound waves so that said left difference sound waves are emanated from a generally horizontal axis at said left-hand location to acoustically combine with said first sound waves emanated from said vertical axis;

radiating second sound waves having a sum component and a difference component so that said second sound waves are emanated from a generally vertical axis at a right-hand location;

radiating right difference sound waves so that said right difference sound waves are emanated from a generally horizontal axis at said right-hand location to acoustically combine with said second sound waves emanated from said vertical axis.

2. The method for spatially enhanced sound reproduction as defined in claim 1, further comprising the steps:

receiving a stereo signal;

applying frequency compensation to an ambient component of said stereo signal; and connecting said ambient component to at least one of said audio speakers.

3. The method for spatially enhanced sound reproduction as defined in claim 1, further comprising the steps of:

orienting said acoustically combined first sound waves and left difference sound waves towards a first ear of a listener; and orienting said acoustically combined second sound waves and right difference sound waves towards a second ear of a listener.

4. A speaker system for reproducing spatially enhanced sound in which audio transducers are located substantially at a left-hand location and a right-hand location whereas the sound experienced by a listener is perceived to emanate over a wide field and not from discrete locations, said speaker system comprising:

a first transducer having a first sum plus difference input, said first transducer positioned at said left-hand location in a substantially vertical axis;

a second transducer having a left difference input, said second transducer positioned at said left-hand location in a substantially horizontal axis, so that sound emitted from said first transducer will acoustically combine with sound emitted from said second transducer when said first and second transducers are energized;

a third transducer having a second sum plus difference input, said first transducer positioned at said right-hand location in a substantially vertical axis; and a fourth transducer having a right difference input, said fourth transducer positioned at said right-hand location in a substantially horizontal axis so that sound emitted from said third transducer will acoustically combine with sound emitted from said fourth transducer when said third and fourth transducers are energized.

5. The speaker system as defined in claim 4, wherein said first transducer is positioned above said second transducer and said third transducer is positioned above said fourth transducer.

6. The speaker system as defined in claim 4, said speaker system further comprising:

a first speaker housing, said first transducer and said second transducer mounted therein; and a second speaker housing, said third transducer and said fourth transducer mounted therein.

7. The speaker system as defined in claim 4, further comprising:

a first chamber having a first volume, said first transducer mounted therein; and a second chamber having a second volume, said second transducer mounted therein, wherein said first volume substantially equals said second volume.

8. The speaker system as defined in claim 4 further comprising a stereo source, said stereo source having a first output and a second output, said first output connected to at least said first transducer, and said second output connected to at least said third transducer.

9. The speaker system as defined in claim 4, said speaker system further comprising:

an audio signal source, said audio signal source having at least a first channel output and a second channel output; and an audio processing system having at least a first processed output and a second processed output, said audio processing system configured to apply frequency correction to at least said first channel output and said second channel output, said first processed output connected to at least said first transducer, and said second processed output connected to at least said third transducer.

10. A method for spatially enhanced sound reproduction, comprising the steps of:

radiating a first sound from a left speaker in a horizontal direction from a first transducer, said first sound having a sum component and a left difference component;

radiating a left difference sound from said left speaker in a vertical direction from a second transducer, so that said left difference sound from said first transducer and said left component sound from said second transducer acoustically combine;

radiating a second sound from a right speaker, said second sound having a sum component and a right difference component, in a horizontal direction from a third transducer; and radiating a right difference sound from said right speaker in a vertical direction from a fourth transducer so that said right difference sound from said third transducer and said right component sound from said fourth transducer acoustically combine and said sum component from said right speaker and said sum component from said left speaker acoustically combine.

11. The method for spatially enhanced sound reproduction as defined in claim 10, further comprising the steps of:

producing a first channel signal;

connecting said first channel signal to at least said first transducer;

deriving a first component of said first channel signal;

connecting said first component of said first channel signal to at least said second transducer;

producing a second channel signal;

connecting said second channel signal to at least said third transducer;

deriving a first component of said second channel signal; and connecting said first component of said second channel signal to at least said fourth transducer.

12. A method of creating an improved acoustic sound field from a pair of speakers positioned about a listener, wherein said speakers reproduce sound derived from stereo audio signals, and wherein said stereo audio signals each comprise a monophonic component representing monaural sounds and a stereo component representing ambient sounds, said method comprising the following steps:

reproducing a first stereo signal through a first acoustic transducer of a first speaker, said first acoustic transducer of said first speaker having a central axis defining a general direction along which sound is projected by said first transducer;

reproducing a stereo component of said first stereo signal through a second acoustic transducer of said first speaker, said second acoustic transducer of said first speaker having a central axis defining a general direction along which sound is projected by said second transducer, wherein said central axis of said first transducer of said first speaker is substantially perpendicular to said second transducer;

reproducing a second stereo signal through a first acoustic transducer of a second speaker, said first acoustic transducer of said second speaker having a central axis defining a general direction along which sound is projected by said first transducer; and reproducing a stereo component of said second stereo signal through a second acoustic transducer of said second speaker, said second acoustic transducer of said second speaker having a central axis defining a general direction along which sound is projected by said second transducer, wherein said central axis of said first transducer of said second speaker is substantially perpendicular to said second transducer.

13. The method of claim 12, wherein said first acoustic transducer and said second acoustic transducer are identical.

14. The method of claim 12, wherein said speakers are placed in a rear left-hand position and a rear right-hand position with respect to a listener.

15. The method of claim 12, wherein said first acoustic transducers of said first and second speakers are oriented towards a listener such that the corresponding central axes are substantially parallel with a floor of a room, and wherein said second acoustic transducers of said first and second speakers are horizontally oriented towards such that the corresponding central axes are substantially perpendicular to said floor of said room.

* * * * *